US010143249B2

(12) United States Patent
West et al.

(10) Patent No.: US 10,143,249 B2
(45) Date of Patent: Dec. 4, 2018

(54) OUTERWEAR GARMENT WITH A CONCEALED STRETCH BACK LAYER

(71) Applicant: Carhartt, Inc., Dearborn, MI (US)

(72) Inventors: Jonathan West, Ferndale, MI (US); Jillian Schopieray, Canton, MI (US); Jennifer Thompson, Milford, MI (US); Deborah Newman, Irvine, KY (US); Iliana Enelia Fiscal Castañeda, Durango (MX); Deana Clarke Hunt, Ferndale, MI (US)

(73) Assignee: Carhartt, Inc., Dearborn, MI (US)

( * ) Notice: Subject to any disclaimer, the term of this patent is extended or adjusted under 35 U.S.C. 154(b) by 253 days.

(21) Appl. No.: 15/152,211

(22) Filed: May 11, 2016

(65) Prior Publication Data

US 2016/0331052 A1 Nov. 17, 2016

Related U.S. Application Data

(60) Provisional application No. 62/161,023, filed on May 13, 2015.

(51) Int. Cl.
*A41D 27/02* (2006.01)
*A41D 3/00* (2006.01)

(52) U.S. Cl.
CPC ..... *A41D 27/02* (2013.01); *A41D 3/00* (2013.01); *A41D 2200/20* (2013.01); *A41D 2500/10* (2013.01)

(58) Field of Classification Search
CPC . A41D 27/06; A41D 1/04; A41D 1/02; A41D 27/04; A41D 27/02
See application file for complete search history.

(56) References Cited

U.S. PATENT DOCUMENTS 708,467 A 9/1902 Dimond
1,721,074 A * 7/1929 Gross ..... A41D 27/10 2/125
2,112,788 A 3/1938 Rosenberg
(Continued)

FOREIGN PATENT DOCUMENTS

WO WO2015/034722 5/2015

OTHER PUBLICATIONS

International Search Report and Written Opinion dated Aug. 4, 2016, for International application No. PCT/US2016/031849, filed on May 11, 2016.

*Primary Examiner* — Tejash Patel
(74) *Attorney, Agent, or Firm* — McAndrews, Held & Malloy, Ltd.

(57) ABSTRACT

An outerwear garment with a concealed stretch back layer disclosed that improves a wearer's range of motion, while maintaining the integrity and function of the outerwear garment. The outerwear garment comprises an outer shell layer, an exterior layer action back, arm sleeve panel and an action back lining. The exterior layer action back is integrated into the back portion of the outer shell layer. The arm sleeve panel is attached to the outer shell layer at least at the front portion and the back portion of the outer shell layer. The action back lining comprises a concealed stretch back layer that is discrete from the outer shell layer and positioned in the back portion of the outer shell layer. The concealed stretch back layer comprises a stretch panel and a shell panel joined together and to the outer shell layer.

28 Claims, 7 Drawing Sheets

(56) References Cited

U.S. PATENT DOCUMENTS

| | | | | | |
|---|---|---|---|---|---|
| 2,252,234 | A | | 8/1941 | Siegal | |
| 2,322,451 | A | * | 6/1943 | Jones | A41D 1/02 2/93 |
| 2,447,989 | A | | 8/1948 | Previdi | |
| 2,457,356 | A | | 12/1948 | Enck | |
| 2,846,686 | A | * | 8/1958 | Tames | A41D 13/1209 2/114 |
| 3,651,520 | A | * | 3/1972 | Jacob | A41D 1/02 2/272 |
| 5,218,720 | A | * | 6/1993 | Tolton | A41D 1/04 2/102 |
| 6,070,274 | A | * | 6/2000 | van der Sleesen | A41D 13/0156 2/456 |

* cited by examiner

OUTERWEAR GARMENT WITH A CONCEALED STRETCH BACK LAYER

RELATED APPLICATIONS

This application claims the benefit of the U.S. Provisional Application 62/161,023, filed on May 13, 2015, the disclosure of which is incorporated herein in its entirety by reference.

BACKGROUND

Embodiments of the present disclosure are directed to outerwear garments, like a coat or jacket, and in particular, to an outerwear garment with a concealed stretch back layer that improves the range of motion of a wearer's arm(s), torso (chest and back) and shoulder in normal use, while maintaining the integrity and function of the outerwear garment. Embodiments of such garments also can maintain the functions desired by the wearer in one or more applications and environmental conditions, and can remain lightweight and comfortable.

Outerwear garments traditionally have outer shells in a single unit or one-piece construction. Such one-piece construction can bind, restrict or otherwise reduce the range of arm, torso and shoulder motion. For example, long sleeves, often present in such garments, tend to bind or restrict motion of the arms, torso and shoulders, particularly when the arms are raised, extended, bent or some combination of those movements, which, in turn, hinder the wearer's ability to move during use.

Another undesirable situation occurs when the wearer moves his/her arms up above the head. In such cases, the body or torso portion of such a coat moves up with arms and raises to expose a portion of the body or an underwear garment of the wearer.

Outerwear garments having full-length zippers, for example, can also binding, restrict or reduce a wearer's range of arm, torso and shoulder motion. Garments with zippers extending from below the waist to the neck or collar area of the wearer can cause considerable binding and restriction in the front of the garment when a wearer moves his/her arms rearward and/or shoulder movement is required.

Yet another undesirable situation exists in garments suited for cold weather conditions or for other conditions for which skin protection is needed, as they also tend to be bulky, either in total materials or outer shell weight. Adding bulk to coats, while helpful in mitigating the effects of certain adverse weather conditions, tends to further of binding, restricting or reducing a wearer's range of arm, torso and shoulder motion, and makes the outerwear less suitable or versatile for active and work environments.

Approaches, like altering the outer shell design (e.g., adding vents) or configuring a coat as a soft shell, tend to lack one or more of overall desired function(s) for use in a given set of applications or conditions. Other hybrid approaches include changing the outer shell material into a flexible material, which affects the integrity and strength of the outer layer in work environments. Yet, other hybrid approaches detach the arm sleeves, in whole or part, from the outer body of the garment. While in other approaches, the arm sleeves are directly coupled to a flexible linings instead of the outer body of the garment. These hybrid approaches have also been tried to increase a wearer's degree of movement. Such approaches have broken the uniformity and integrity of the outer fabric of the garment, add more exposed or moving elements to a coat, and/or impeded the performance and functions of the outerwear.

A traditional-looking and functional outerwear garment that delivers an improved range of motion of a wearer's arm(s), torso (chest and back) and shoulder in normal use, while maintaining the integrity and function of the outerwear garment improved range of motion is described in detail below. The above information is presented as background information only to assist with an understanding of the present disclosure. No determination has been made, and no assertion is made, as to whether any of the above might be applicable as prior art with regard to the present disclosure.

BRIEF SUMMARY

An outerwear garment with a concealed stretch back layer is disclosed that improves a wearer's range of motion, while maintaining the integrity and function of the outerwear garment. The outerwear garment comprises an outer shell layer, an exterior layer action back, arm sleeve panel and an action back lining. The exterior layer action back is integrated into the back portion of the outer shell layer. The arm sleeve panel is attached to the outer shell layer at least at the front portion and the back portion of the outer shell layer. The action back lining comprises a concealed stretch back layer that is discrete from the outer shell layer and positioned in the back portion of the outer shell layer. The concealed stretch back layer comprises a stretch panel and a shell panel joined together and to the outer shell layer.

BRIEF DESCRIPTION OF SEVERAL VIEWS OF THE DRAWINGS

The features and utilities described in the foregoing brief summary, as well as the following detailed description of certain embodiments of the present general inventive concept below, will be better understood when read in conjunction with the accompanying drawings.

Figure 1:
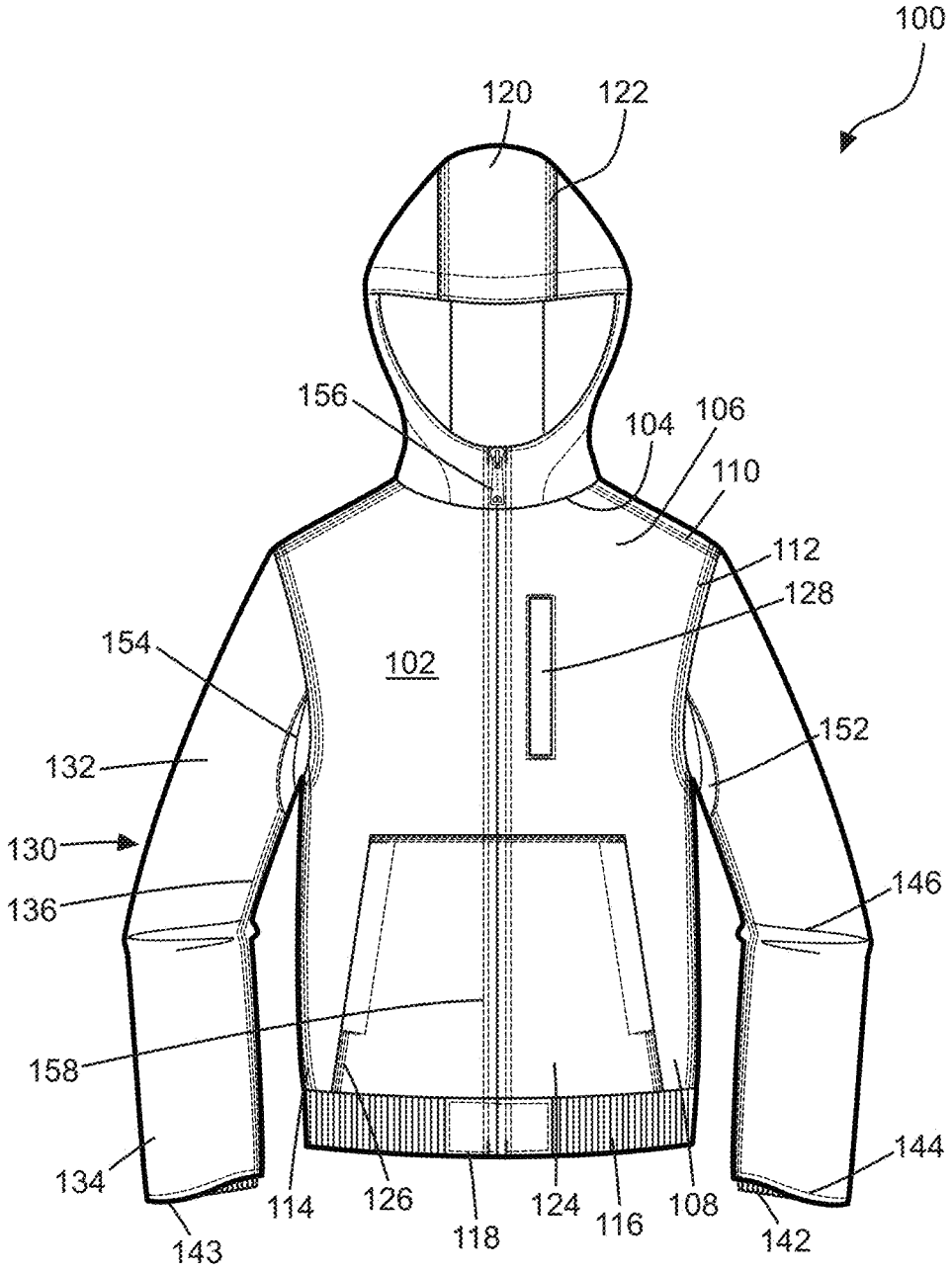
FIG. 1 illustrates a front exterior view of a portion of an outer shell layer of an outerwear garment corresponding to wearer's front according to an embodiment of the present disclosure.

For the purpose of illustrating the general inventive concept, certain embodiments are shown in the drawings. Also, any hatching or shading shown in the drawings is provided for illustration purposes. It should be understood, however, that the present disclosure is not limited to the arrangements and instrumentality shown in the attached drawings.

DETAILED DESCRIPTION

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to an embodiment illustrated in the figures.

Advantages and features of the present disclosure and methods of accomplishing the same may be understood more readily by reference to the following detailed description and the drawings. The present general inventive concept may, however, be embodied in many different forms of being practiced or of being carried out in various ways and should not be construed as being limited to the embodiments set forth herein. Rather, these embodiments are provided so that this disclosure will be thorough and will fully convey the general inventive concept to those ordinarily skilled in the art. The present general inventive concept is defined by the appended claims. In the drawings, drawing features (e.g., thickness of layers and regions) are exaggerated for visual clarity.

Unless defined otherwise, all technical terms used herein have the same meaning as understood by one of ordinary skill in the art to which this invention belongs. Further, unless defined otherwise, all terms defined in generally used dictionaries should have their ordinary meaning. Also, the phraseology and terminology used in this document are for the purpose of description and should not be regarded as limiting. The use of the terms "a" and "an" and "the" and similar references in the context of describing the invention (e.g., in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Embodiments can be generally described as comprising a combination of constructed or assembled components in an outerwear garment. Such an outerwear garment addresses a wearer's need for improved range of motion in an active outerwear garment while at the same time maintaining or improving comfort, fit, usability and/or durability.

Figure 2:
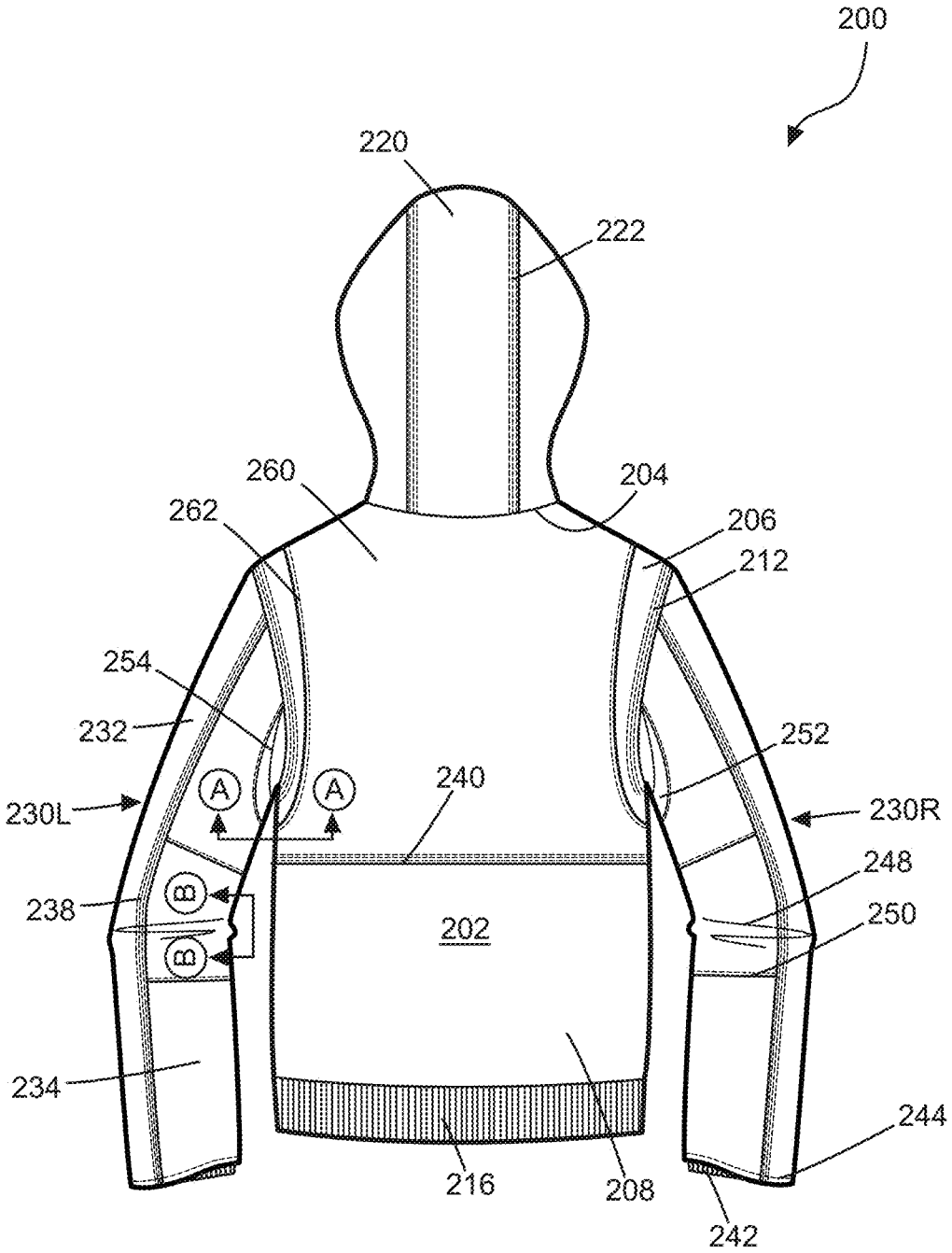
FIG. 2 illustrates a back exterior view of a portion of an outer shell layer of an outerwear garment corresponding to wearer's back according to an embodiment of the present disclosure.

Referring now to FIGS. 1 and 2, exemplary embodiments of outerwear garment 100 are shown. A typical wearer of outerwear garment 100 can be a man, woman or child.

Outerwear garment 100 comprises a front portion corresponding to a wearer's front (as shown from one side in FIG. 1), and a back portion corresponding to a wearer's back (as shown from a second side in FIG. 2). Specifically, FIG. 1 illustrates a front exterior view of a portion of an outer shell layer 102 of the outerwear garment 100 that corresponds to the wearer's front. FIG. 2 illustrates a back exterior view of a portion of an outer shell layer 202 of the outerwear garment 200 that corresponds to the wearer's back.

Referring now more specifically to the embodiment of FIG. 1, FIG. 2 illustrates a front exterior view of a portion of an outer shell layer 102 of the outerwear garment 100 that corresponds to the wearer's front. FIG. 1 illustrates the outer shell layer 102 in relation to a collar region 104, an upper shell layer region 106, a lower shell layer region 108, a hood 120 and arm sleeve panel 130. Outer shell layer 102 shown in FIGS. 1 and 2 is the portion of the garment 100 exposed to the environment.

In general, outerwear garment 100 is a garment type typically worn in active environments. Outerwear garment 100 may comprise a wide variety of materials, sizes, textures, fabrics, colors, lengths, durabilities, and may have configurations that depend, for example, on the wearer's preferences and the type of active environment that the outerwear garment 100 is expected to be used in. Outerwear garment 100 can be worn for protection (e.g., water protection, fire, elevation-related), a specific activity or occupational function (e.g., firefighters, athletes, hunters, medical workers (e.g., scrubs), construction workers, skiers, soldiers, etc.), warmth and/or fashion.

By way of further example, materials from which all or part of outerwear garment 100 may be constructed comprise: cotton, duck, nylon, Sherpa, synthetic, fleece, rip stop cotton, stretch fabric, insulating material (e.g., Thinsulate® (a trademark of 3M), Cordura® (a trademark of Invista), abrasion resistant material, tear resistant material, rip resistant material, puncture resistant material (e.g., high tenacity fiber), heat resistant material, electrically insulating material, fire resistant material (for various Hazard Risk (HR) categories and safety standards (NFPA 202/70E, ASTM1506), e.g., Nomex® (a trademark of DuPont), flame proof materials, elastic materials, material blends (e.g., spandex, also known a LYCRA® (a trademark of Invista)) or sandstone, to name a few. The outerwear garment 100 may be of various colors (e.g., black, gray, brown, camouflage, green, red, pink, orange, yellow, etc.) and styles for a given activity or to suit the wearer's personal preferences.

Outerwear garment 100 can also include features including: anti-odor, stain resistant, sweat wicking, water repellant or proof, flame resistant or proof, waterproof breathable and wrinkle resistant or proof, for example. Commercially available outerwear technologies or features from the present assignee, like Rain Defender®, Storm Defender®, Stain Breaker®, Fast Dry®, Rugged Flex® and Force®, may be incorporated to varying degrees into the outerwear garment 100, depending on the application, without deviating from contemplated embodiments of the outerwear garment 100. Additionally, outerwear garment 100 may take the form of a coverall (not shown) or be used in conjunction with a bib (not shown). Outerwear garment 100 may also include application specific features, e.g., a lanyard access. Other similar features are contemplated as well.

Various fabric configurations of outer shell layer 102 are contemplated for such an outerwear garment 100. An exemplary outer shell layer 102 configuration is one comprising a sandstone outerwear garment 100 (e.g. in the form of jacket) that has a fabric content of 100% cotton sandstone duck and has a fabric weight of about twelve ounces (12 oz.). Another exemplary outer shell layer 102 configuration is one comprising an outerwear garment 100 having a stretch sandstone of 98% cotton and 2% spandex, and has a fabric weight of about ten-and-one-half ounces (10.5 oz.), which includes a Cordura trim on high wear areas of the cuff and bottom hem. Yet another exemplary outer shell layer 102

(e.g. in the form of shirt jacket) is one that has a fabric content of 59% Cotton/39% Polyester/2% Spandex (with durable water repellant (DWR) finish) and has fabric weight of about eight ounces (8 oz.). It is understood that the fabric configurations of outer shell layer 102 are merely provided by way of example. Other fabric configurations of the outer shell layer 102 are contemplated.

Outerwear garment 100 may be made up of several pieces to form the outerwear garment 100. Some embodiments of the outer shell layer 102 comprise a shoulder seam 110, and an armhole sleeve seam 112 and outer shell layer side seam 114.

In the embodiments illustrated, the front portion of the outerwear garment 100 in FIG. 1 can be joined together with a back portion of the outerwear garment 200 in FIG. 2 along at least a shoulder seam 110 and an outer shell layer side seam 114. Triple stitch seams, as shown in FIGS. 1 and 2, may be used for increased strength, durability and a rugged aesthetic. A person of skill in the art will understand that all seams in the illustrated embodiments of the outerwear garment 100 may be located in other positions than illustrated, be waterproof and/or be otherwise configured using other stitch techniques, welding techniques (e.g., adhesive materials) and styles of joining clothing materials.

Arm sleeve panel 130 has an upper arm sleeve panel region 132 and a lower arm sleeve panel region 134. Arm sleeve panel 130 typically comprises the same fabric or material used for the outer shell layer 102. Arm sleeve panel 130 may be a one-piece (e.g., no seams along the length of the arm sleeve panel 130) or made up of one or more pieces (e.g., with one or more seams) to form arm sleeve panel 130. In some embodiments, pieces of arm sleeve panel 130 are joined together at a first arm sleeve seam 136 (e.g., along the inside of the arm sleeve panel 130 as shown in FIG. 1) and at a second arm sleeve seam 238 (e.g., along the back of the arm sleeve panel 230 shown in FIG. 2). Triple stitch seams, as shown in FIGS. 1 and 2, may be used to join pieces of arm sleeve panel 130 for increased strength, durability and a rugged aesthetic. A person of skill in the art will understand that all seams in the illustrated embodiments of the outerwear garment 100 may be located in other positions than illustrated, be waterproof and/or be otherwise configured using other stitch techniques, welding techniques (e.g., adhesive materials) and styles of joining clothing materials.

Arm sleeve panel 130 may employ a front arm sleeve pleat 146 on the front portion of the arm sleeve panel 130 in FIG. 1. In some embodiments of the outerwear garment 100, like that shown in FIG. 1, front arm sleeve pleat 146 may extend the width of the sleeve panel. The front arm sleeve pleat 146 is located in the region anticipated for the front of the wearer's elbow. In some embodiments, no pleats are included, and in yet other embodiments, more than one arm sleeve pleat is provided.

In some embodiments of the outerwear garment 100, the arm sleeve panel end 143 of the lower arm sleeve panel region 134 may be straight, angled or other configuration at an opening (not fully shown) of arm sleeve panel 130 for the wearer's hand. Additionally, the lower arm sleeve panel region 134 may include a wrist or storm cuff 142, which, for example, may be a form-fitting elastic wrist cuff and may be rib-knit wrist cuffs.

The wrist cuff 142 may be wholly exposed, partially exposed or hidden from view. The wrist cuff 142 may be joined at, or near, the wrist cuff seam 144. Wrist cuff 142 of arm sleeve panel 130 may be form fitting to or adjustable (e.g., to loosen or tighten) against a portion of the arm or wrist of a wearer. Such a wrist cuff 142 may accommodate the lengthening effect of the arm sleeve panel 130 in relation to the outer shell layer 102, during a wearer's use and movement.

In embodiments where outer shell layer 102 and arm sleeve panel 130 are not one, integral piece, the arm sleeve panel 130 may be directly attached to the outer shell layer 102. More specifically, the arm sleeve panel 130 may be attached to the outer shell layer 102 at least at a front portion and a back portion of the outer shell layer 102. For example, the arm sleeve panel 130 may be joined at the upper arm sleeve panel region 132 at, or to a region near, the shoulder seam 110 of the outer shell layer 102. Arm sleeve panel 130 may also be joined at, or to a region near, the armhole sleeve seam 112 in the armpit area of the outerwear garment 100. A portion of the arm sleeve panel 130 in some embodiments also may be joined to an armhole gusset 152, which, in turn, may be joined to the outer shell layer 102 at, or to a region near, the armhole sleeve seam 112.

Armhole gusset 152 is shown as a two-piece armhole gusset joined together at armhole gusset seam 154. As discussed further below, armhole gusset 152 may be a one-piece or more than one-piece configuration.

Referring now to FIG. 2, FIG. 2 illustrates a back exterior view of a portion of an outer shell layer 202 of the outerwear garment 200 that corresponds to the wearer's back. Outerwear garment 200 has a garment shell layer or outer shell layer 202. FIG. 2 illustrates the back portion of outer shell layer 202 in relation to a collar region 204, upper shell layer region 206, lower shell layer region 208, hood 220 and arm sleeve panel 230.

As illustrated in FIG. 2, a second arm sleeve seam 238 may connect the front portion and back portion of the arm sleeve panel 230. Second arm sleeve seam 238 may extend a part or the entire length of arm sleeve panel 230 between an upper arm sleeve panel 232 and lower arm sleeve panel 234. A midriff back seam 240 may be employed to connect, in whole or part, an action back lining 464 to, or through the inside of, the outer shell layer 202. Triple stitch seams, as shown in FIGS. 1 and 2, may be used for increased strength, durability and a rugged aesthetic. A person of skill in the art will understand that all seams in the illustrated embodiments of the outerwear garment 100 may be located in other positions than illustrated, be waterproof and/or be otherwise configured using other stitch techniques, welding techniques (e.g., adhesive materials) and styles of joining clothing materials.

In some embodiments, an exterior layer action back 260 may be constructed in the upper shell layer region 206 of the outer shell layer 202. The exterior layer action back 260 may be integrated into the back portion of the outer shell layer 202 and may extend into some or the entire lower shell layer region 208. Conventional configurations for exterior layer action back 260 are contemplated; for example, an exterior bi-swing action back configuration could be employed.

As a person of skill should appreciate, the exterior layer action back 260 in some embodiments may be joined, via a fold or pleat of material (not shown), to the remainder of the upper shell layer region 206 at an exterior layer action back seam 262. The material for the fold or pleat (not shown) of exterior layer action back 260 typically may be the same as the material used for the outer shell layer 202, but it need not be. The fold or pleat material (not shown) may also comprise several folds or pleats, or a more (or less) elastic, porous and/or insulating material.

Other configurations for the exterior layer action back 260 are contemplated. For example, exterior layer action back 260 could be positioned in the center of the upper shell layer region 206 of the outerwear garment 200 in addition to, or on lieu of, a pleat or fold (not shown) near the shoulder of the wearer. Similarly, a conventional jacket vent may be employed as part, or all, of the exterior layer action back panel 260. Exterior layer action back panel 260, as illustrated in FIG. 2, contributes to increasing the degree of bending, flexion and extension, when the wearer's shoulders, torso, and arms away from the wearer's body, for example.

In some embodiments of the outerwear garment 200, like that shown in FIG. 2, arm sleeve panel 230 may also include a back arm sleeve pleat 248 on the back portion of the arm sleeve panel 230 as depicted in FIG. 2. In the embodiment of FIG. 2, the back arm sleeve pleat 248 is located in the region anticipated for the wearer's elbow and is secured to the arm sleeve panel 230 at least along arm sleeve pleat seam 250.

Back arm sleeve pleat 248 may extend the entire width, or some portion thereof, of the arm sleeve panel 230. In general, arm sleeve pleats 146, 248 may be located on each side of the wearer's elbow where the wearer's arm is anticipated to bend, flex or extend. When arm sleeve pleats 146, 248 are included, the wearer may have an increased bending, flexion or extension capability. For example, in the embodiment illustrated in FIGS. 1 and 2, the arm sleeve pleats 146, 248 may be complementary to each other and enable the wearer to more naturally and fully bend, flex or extend without, for example, additional bulk on the interior of the outerwear garment.

Figure 3:
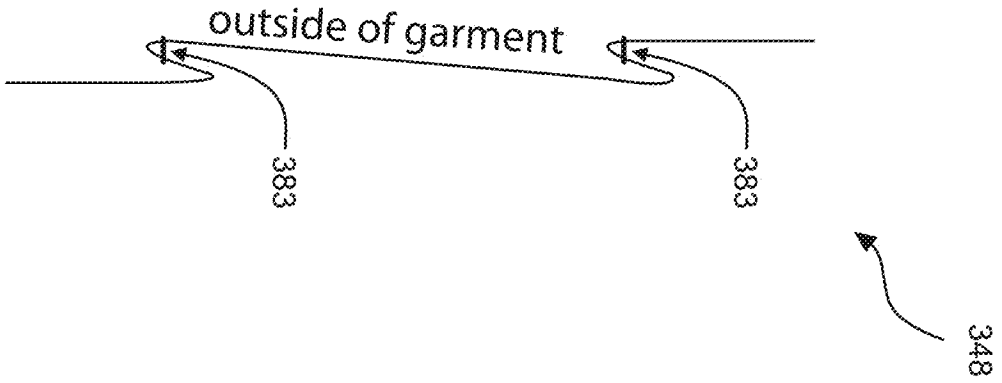
FIG. 3 illustrates cross-sectional view along section lines B-B in FIG. 2 of an elbow pleat configuration according to an embodiment of the present disclosure.

FIG. 3 shows a cross-sectional view, along section line B-B in FIG. 2 of a configuration of back arm sleeve pleat 348 that may be used in outerwear garment 200. Back arm sleeve pleat 348 may have various depths depending, for example, on the size of the outerwear garment 200 and the type of material forming back arm sleeve pleat 348. By way of example, a depth for arm sleeve pleat 348 of about one inch (1") may be acceptable for a medium-sized outerwear garment 200. The configuration of FIG. 3 also shows a back arm sleeve pleat 348 as opening downward, and including a pleat edgestich 383. Other configurations for pleats 146 and 248 are known and contemplated.

In embodiments where the outerwear garment 100 is not a one-piece, pull-over, the outerwear garment 100 will have an open configuration and a closed configuration. The open configuration (not shown) may be changed to a closed configuration, in whole or part, by use of a garment fastener 156. A closed configuration is illustrated in FIG. 1. In some embodiments, garment fastener 156 is joined to the outer shell layer 102 at the garment fastener seam 158.

Any of a variety of means may be used as a garment fastener 156 to close the outerwear garment 100. For example, the embodiment of FIG. 1 depicts a garment fastener 156 in the form of a zipper. The zipper may be complemented with a storm flap (not shown). Other garment fasteners are contemplated, including, hook and loop fasteners, buttons, belts, toggles or a combination. When outerwear garment 100 is of the pull-over variety, a garment fastener 156 would not necessarily be required to close the outerwear garment 100.

Persons of skill in the art will appreciate that the outer shell layer 102 could also be longer or shorter than the waist region of the wearer. For example, outerwear garment 100 could extend to the ankle region of the wearer.

In embodiments of garment 100 where the lower shell layer region 108 terminates in the area of the wearer's waist, some embodiments of outerwear garment 100 comprise a waist or bottom band 116 that is seamed together at least with the outer shell layer 102 at the waist band seam 118. In other embodiments, a waist band 116 is not employed when the outerwear garment terminates at the wearer's waist or hip region of the wearer. Other embodiments may have a drop-tail or other configurations (not shown).

Waist band 116 may be of an elastic material, e.g., a stretchable spandex-reinforced rib knit. Use of an elastic material for waist band 116 can help to more snuggly fit portions of the lower shell layer region 108 to the wearer's waist or hip region. When the outerwear garment 100 terminates below (or above) the wearer's waist or hip region, however, a waist band 116 may not be employed. An elastic waist cord (not shown) positioned at or near a bottom hem of the lower shell layer region 108 may be employed, when the garment terminates below, above or at the wearer's waist or him region.

As illustrated in FIG. 1, embodiments of outerwear garment 100 may optionally include a hood 120. Hood 120 may be integrally connected or removably connected to the outer shell layer 102. For example, an under collar snap (not shown) could be included to removably attach the hood 120 to the collar region 104 or other part of the outerwear garment 100.

Hood 120 itself may be one-piece or made up several pieces to form the hood 120. Hood 120 may be lined or insulated (e.g., flannel or sherpa-lined), and may include a draw string or cord closure. A visor or face mask (not shown) may be configured with the hood 120.

In FIG. 1, pieces of hood 120 are shown as joined together at a hood seam 122. Triple stitch seams, as shown in FIGS. 1 and 2, may be used to join pieces of hood 120 for increased strength, durability and a rugged aesthetic. A person of skill in the art will understand that all seams in the illustrated embodiments of the outerwear garment 100 may be located in other positions than illustrated, be waterproof and/or be otherwise configured using other stitch techniques, welding techniques (e.g., adhesive materials) and styles of joining clothing materials.

As further illustrated in FIG. 1, embodiments of garment 100 may include any number of pockets in any of many locations for a variety of purposes (e.g., pockets 124). Pockets 124 may be constructed in a variety ways and may be lined, or otherwise insulated. Pockets 124 are used typically as hand warmers or for accessory storage. Other pockets (e.g., including patch, cargo, flap, zipper pockets) may be included for accessories or drop-in devices (like mobile or medical devices) or for other purposes, like pocket 128. Pockets 124 or other included pockets may also be configured to accommodate media ports. Pen stalls (not shown) may also be included in the outerwear garment 100.

Pockets 124, when constructed as shown in the embodiment of the FIG. 1, typically comprise the same fabric or material used for the outer shell layer 102. For example, pockets 124 are joined together with the outer shell layer 102 at various points around the periphery of the pockets 124 at a pocket seam 126 using various stitching styles. Pockets 124 may be closed at any openings by using commonly known means, e.g., zipper, buttons, Velcro, magnets or flaps. A person of skill in the art will appreciate that a variety of pocket configurations could be incorporated into the outer shell layer 102 without departing from the contemplated embodiments of the outerwear garment 100.

Referring now to FIG. 4, an embodiment of action back lining 464 is illustrated, which may comprise various integrated components. FIGS. 4A-4D illustrate an embodiment of components that may be constructed together to form action back lining 464. Other embodiments of the action back lining 464 may be constructed of more or less components than shown in FIGS. 4A-4D. The action back lining 464 or portions thereof (e.g., a stretch back layer 466) may be fully hidden or concealed from view from the exterior of the outerwear garment 200. Action back lining 464 may alternatively be partially concealed from view from the exterior of the outerwear garment 200. In some other embodiments, the action back lining 464 could be exposed, in whole or part, when the interior of the garment 100 is viewable, for example.

In the embodiment illustrated, the action back lining 464 is a discrete unit from outer shell layer 202. It may be located in the upper shell layer region 206 and/or in other regions of the outerwear garment 200. Typically, the action back lining 464 may be located between the shoulders. Locating action back lining 464 between the shoulders may enhance recovery and recovery time of the outerwear garment 100 to various movements of the wearer.

Embodiments of action back lining 464 may be configured to maintain a relatively uniform appearance and integrity of the fabric employed for the outer shell layer 202. For example, the action back lining 464 may be typically located on, or through, the inside of the outer shell layer 202. Action back lining 464 may be inserted into the upper shell layer region 206 of the outerwear garment 200, which may be further configured together with an exterior layer action back panel 260 that is in the form of a deep, traditional bi-swing action back. In some embodiments, action back lining 464 may be an accessory that is selectively insertable and removable by the wearer or others into the garment 200 for use in a specific environment or to achieve a desired degree of bending, flexing and extension of outerwear garment 100 for a given activity.

Additionally, in other embodiments, a garment interior lining 788 may be also placed over and/or integrated with action back lining 464. Employing action back lining 464 permits the outerwear garment 100 to be made with no other stretch panels in the outer shell layer 102, as used in soft shells and other hybrid outerwear coats, and allows the outerwear garment 100 to more closely match the wearer's body and movement.

Figure 4A:
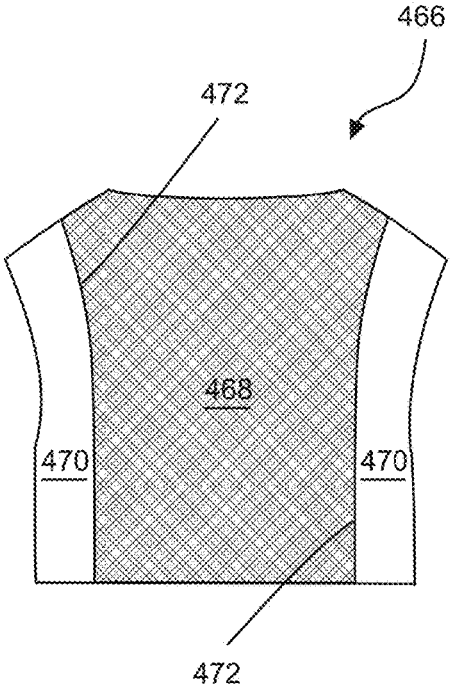
FIG. 4A illustrates a stretch back layer of an action back lining according to an embodiment of the present disclosure.

FIG. 4A illustrates a stretch back layer 466 of the action back lining 464 that comprises a stretch panel 468 (e.g., a stretch knit fabric) and a shell panel 470 (e.g., a shell fabric). Stretch panel 468 is illustrated in a central portion of the action back lining 464 and is typically the component layer of the action back lining 464 closest to the wearer's body. Stretch panel 468 would typically not be the layer or lining closest to the wearer's skin in the finish garment 100, as other linings (e.g. garment interior lining 788) may be a layer closest to the wearer's body in the finished garment 100.

A wide variety of filaments and spun yarns, for example, with a degree of elastic or elastic-like properties are contemplated for the action back lining 464 and, particularly, the stretch panel 468. The elastic or elastic-like properties of the action back lining 464 aid the outer shell layer 202 to return to its relaxed position, but, at the same time, give the wearer a high degree of bending, flexing and extension capability during active wear. Some examples include spandex, spandex blends, nylon, polyester, elastane, cotton, synthetic fiber, polymer composites, polymer blends, rubber, knitted fabric, and other elastomeric fibers that provide a degree of mechanical stretch. Generally, the typical mechanical and chemical properties for materials suitable for the stretch panel 468 are those favoring elasticity and wearability. Some properties that may be considered for materials suitable for the stretch panel 468 are thickness, tenacity, density, weave pattern, elongation at break, stress, strain, moisture regain, resiliency, wash-ability, bleach resistance, for example. The stretch panel 468 is such that it may stretch multi-directionally or only in some directions, and could be made of any material that could allow for such movement.

In FIG. 4A, shell panel 470 is positioned on each side of the stretch panel 468. Various other configurations are contemplated, such as employing a single stretch panel 468, with a suitable degree of elasticity or flexibility. Alternatively, other configurations could employ two or more stretch panels 468 and/or shell panel 470 that together may provide a suitable degree of elasticity or flexibility.

Figure 4B:
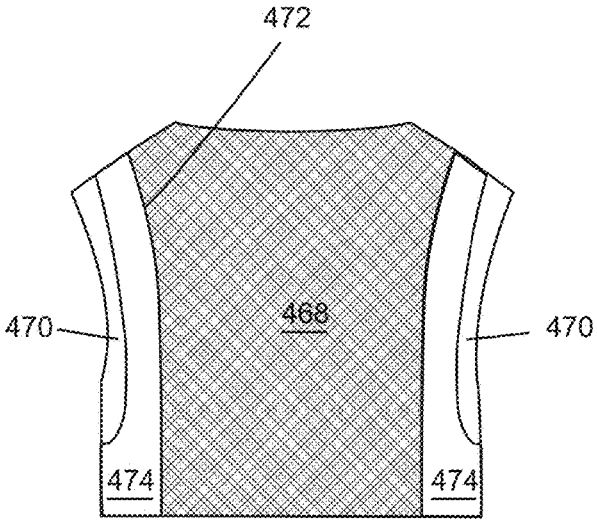
FIG. 4B illustrates a facing panel assembled together with the stretch back layer of an action back lining according to an embodiment of the present disclosure.

FIG. 4B illustrates the addition of a facing panel 474 to the stretch back layer 466 of FIG. 4A. Facing panel 474 may be a shell fabric facing piece. Stretch panel 468 may be joined together with the shell panel 470 and facing panel 474, where the facing panel 474 is set into the stretch panel seam 472 as illustrated in FIG. 4B.

Figure 4C:
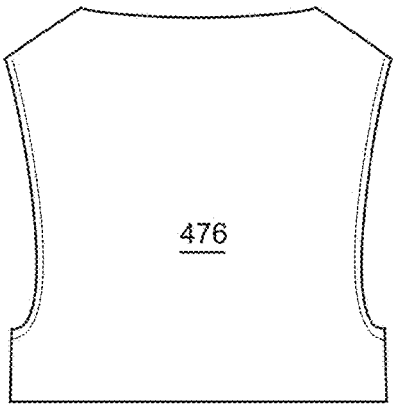
FIG. 4C illustrates an outer fabric layer of an action back lining according to an embodiment of the present disclosure.

FIG. 4C shows an additional component that comprises an outer fabric layer 476 of the illustrated embodiment of action back lining 464. Outer fabric layer 476 is positioned on top of the stretch panel 468, shell material 470 and facing panel 474. In some embodiments, outer fabric layer 476 is so positioned once the facing panel 474 is set into the stretch panel seam 472.

Figure 4D:
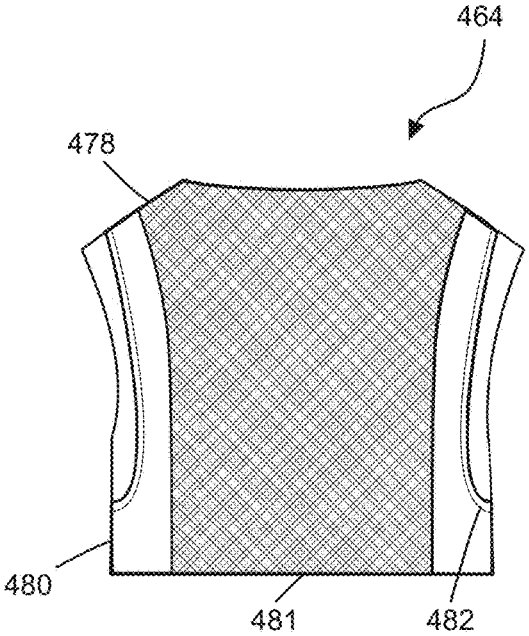
FIG. 4D illustrates an assembled action back lining according to an embodiment of the present disclosure.

FIG. 4D illustrates all components of the illustrated embodiment of action back lining 464 assembled and joined at one or more facing edges 478, 480, 481, 482. The action back lining 464, as a whole or in parts, may be also joined to the outer shell layer 202 at one or more of the shoulder seam 110, outer shell layer side seam 114, and midriff back seam 240. Configuring the action back lining 464 as illustrated allows the outer shell layer 102 and action back lining 464 to deliver a maximum extension and function of the exterior layer action back 460, and in turn, provide the wearer with an improved range of motion through the arms, shoulder, torso, and particularly, the upper back of the outer garment 200.

As a skilled artisan will appreciate, when the wearer reaches or extends their arms to an extended position from a relaxed position, the stretch back panel 468 and facing panel 474 extend, and allows improved ease of movement, including through the upper back, without any need to alter the outward integrity and appearance of the outer shell fabric 102. As the wearer returns his/her arms back to a relaxed position, the stretch back panel 468 contributes to force the facing panel 474 back into its relaxed position. The action back lining 464, among other things, facilitates a reduction in fabric bulk and provides the wearer with a better range of motion. Other configurations and ways for attaching action back lining 464 are contemplated.

Figure 5:
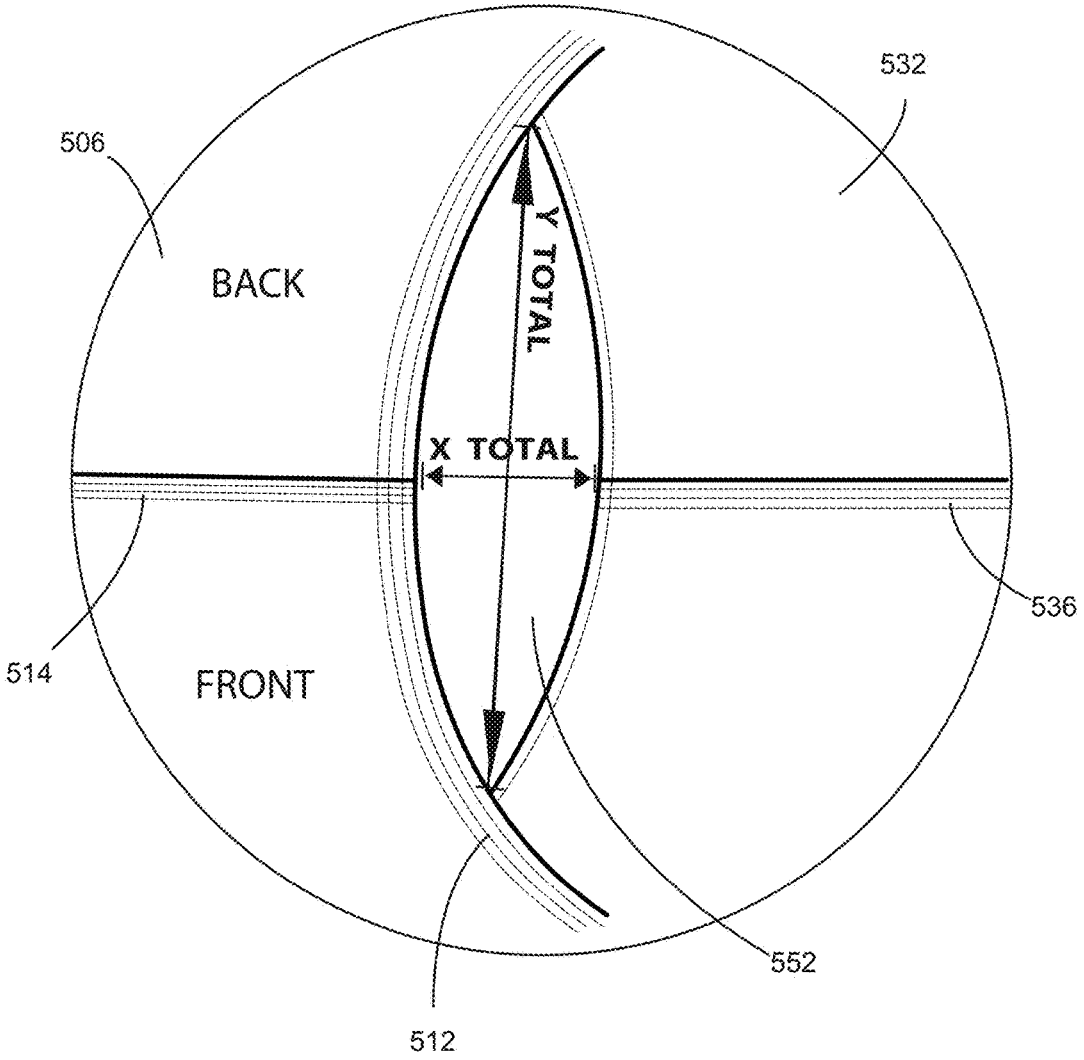
FIG. 5 illustrates an armhole gusset configuration depicted along section lines A-A in FIG. 2 according to an embodiment of the present disclosure.

FIG. 5 illustrates an embodiment of the armhole gusset 552. Armhole gusset 552 is typically located under the arm or in the armpit area of the wearer. FIG. 5 is a view taken along line A-A shown in FIG. 2.

FIG. 5 is a view showing the armhole gusset 552 in relation to parts of the back of upper shell layer region 506, armhole sleeve seam 512, outer shell layer side seam 514, upper arm sleeve panel 532, and arm sleeve seam 536. In the illustrative embodiment, the armhole gusset 552 comprises a two-piece armhole gusset. Embodiments are contemplated where the right arm sleeve panel 230R, left arm sleeve panel 230L, or both, may have an armhole gusset 552 connected to, or integrated with, an outer surface of arm sleeve panel 230.

Armhole gusset 552 may take a traditional gusset shape. In the embodiment illustrated in FIG. 5, the armhole gusset 552 is depicted with an "X" dimension and a "Y" dimension, and is depicted in this embodiment in the approximate shape of a football shape or prolate spheroid; although, the skilled artisan will appreciate that the specific shape of the armhole gusset 552 can vary. In the two-piece armhole gusset embodiment, by way of one example, the armhole gusset 552 could have an about eight and one-quarter inch (8.25") length in the "Y" dimension and about three inch (3") width in the "X" dimension.

Armhole gusset 552 may be configured with a single fold or may be multiple folds. A fold line also may be formed in the armhole gusset 552, and, in certain embodiments, can extend transversely across the sleeve. If an armhole gusset seam 154 is included (as shown in FIGS. 1 and 2), armhole gusset seam 154 may be a fold line that further allows the armhole gusset 552 to fold back on itself near or along armhole gusset seam 154, when the wearer's arm is in a relaxed position. In other embodiments, when the wearer's arm is in a relaxed position (e.g., when the wearer's arm is hanging down straight), the armhole gusset 552 may fold on itself in an accordion-like fashion, forming an accordion-like fold at an inner angle of a wearer's armpit. In general and regardless of configuration for the armhole gusset 552, when the wearer's arm is extended in front of the wearer's body or head, the armhole gusset 552 unfolds.

Armhole gusset 552 may be made as long as possible for maximum function without coming past an armhole crease. Once the armhole gusset 552 extends past such armhole crease, the armhole gusset 552 may not facilitate any degree of additional movement for the wearer and can create undesirable excess fabric and gathering.

Armhole gusset 552 eases wearer's movement in allowing for a closer fit to the body and armhole area, and contributes to the outerwear garment 100 not to rising upward as much and staying closer to its original relaxed position, when the wearer extends or raises his/her arms above their head or in front of the wearer's body. The additional fabric provided by armhole gusset 552 enhances the wearer's ability to move his or her arm to overhead, while at the same time minimizing undesired binding and bulk at the armhole intersection typically found on a traditional set in sleeve. Reduced binding and reduced bulk of outerwear garment 100, which provides better wearer comfort and movement. Or, put another way, the armhole gusset 552 may provide a higher degree of freedom of movement to the wearer.

As should be apparent to one of skill in the art, action back lining 464, particularly when used in connection with the armhole gusset 552 of outerwear garment 100, not only minimizes rise, but, the combination greatly improves how far a wearer's arms can reach up over the head and extend in front of wearer's body. By way of example, the garment rise of a Quick Duck Traditional Jacket, a commercially garment available from present assignee, has an approximately eight inch (8") rise from its original position when the both arms of a wearer are above the wearer's head. An embodiment of outerwear garment 100 has an approximately five-and-one-half inch (5.5") rise from its original position when the both arms of a wearer are above the wearer's head. The approximate difference is a notable two-and-one-half inch (2.5") difference.

Figure 6:
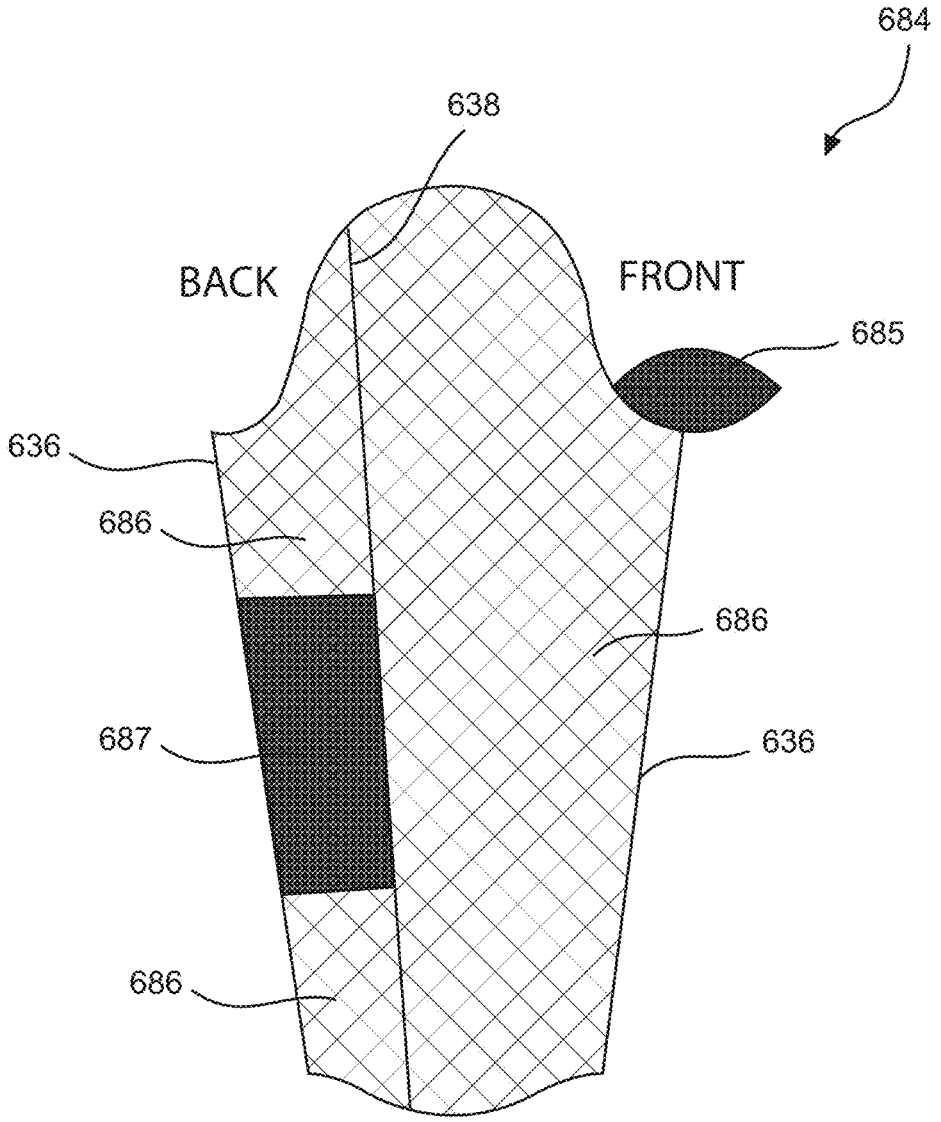
FIG. 6 illustrates an arm interior lining stretch piecing configuration including an elbow stretch fabric and an armhole gusset stretch fabric according to an embodiment of the present disclosure.

FIG. 6 illustrates an arm interior lining stretch piecing 684. Additionally, to complement the armhole gusset 552, an armhole gusset stretch fabric 685 may also constructed and connected to, or integrated with, the garment interior lining 788. The arm interior lining stretch piecing 684 may also comprise an elbow stretch fabric 687 according an embodiment of the present disclosure.

In some embodiments, an arm interior lining stretch piecing 687 is pieced in the elbow area of the garment interior lining 788 along a first arm sleeve seam 136 and a second arm sleeve seam 138. Integrated together in the arm interior lining stretch piecing 684 is an armhole gusset stretch fabric 685 (e.g., spacer mesh fabric), an elbow fabric 686 (e.g., a mid-weight quilt fabric) and an elbow stretch fabric 687 (e.g., a spacer mesh fabric).

Other embodiments of the arm interior lining stretch piecing 684 may be configured as a single fabric, or as two or more fabrics that have a suitable elasticity. Stretch fabric may be of a similar material as a stretch panel 468, for example.

Arm interior lining stretch piecing 684 may further enhance function of the armhole gusset 552 and/or elbow pleats 146, 248, enhance wearer movement and/or reduce bulk of the outerwear garment 100. The armhole gusset stretch fabric 685 and elbow stretch fabric 687 are each positioned and shaped to work in a complementary fashion with the respective armhole gusset 552 and/or one or more pleats 146, 248. For example, beyond any contribution to the performance of the armhole gusset 552 and/or one or more pleats 146, 248 that the arm interior lining stretch piecing 684 may provide overall in bending, flexing or extension, the armhole gusset stretch fabric 685 may enhance the respective performance of the armhole gusset 552 and, similarly, the elbow stretch fabric 687 may enhance the performance of the one or more pleats 146, 248 during bending, flexing or extension of the wearer. In some embodiments, inclusion of arm interior lining stretch piecing 684, armhole gusset 552, elbow pleats 146, 248, and the exterior layer action back 260 with the action back lining 464 in embodiments of the garment 100 work together to provide the wearer a higher degree of freedom and overall range of motion (e.g., bending, flexing or extension), while still providing a traditional, outwardly appearing outer garment 100.

Figure 7:
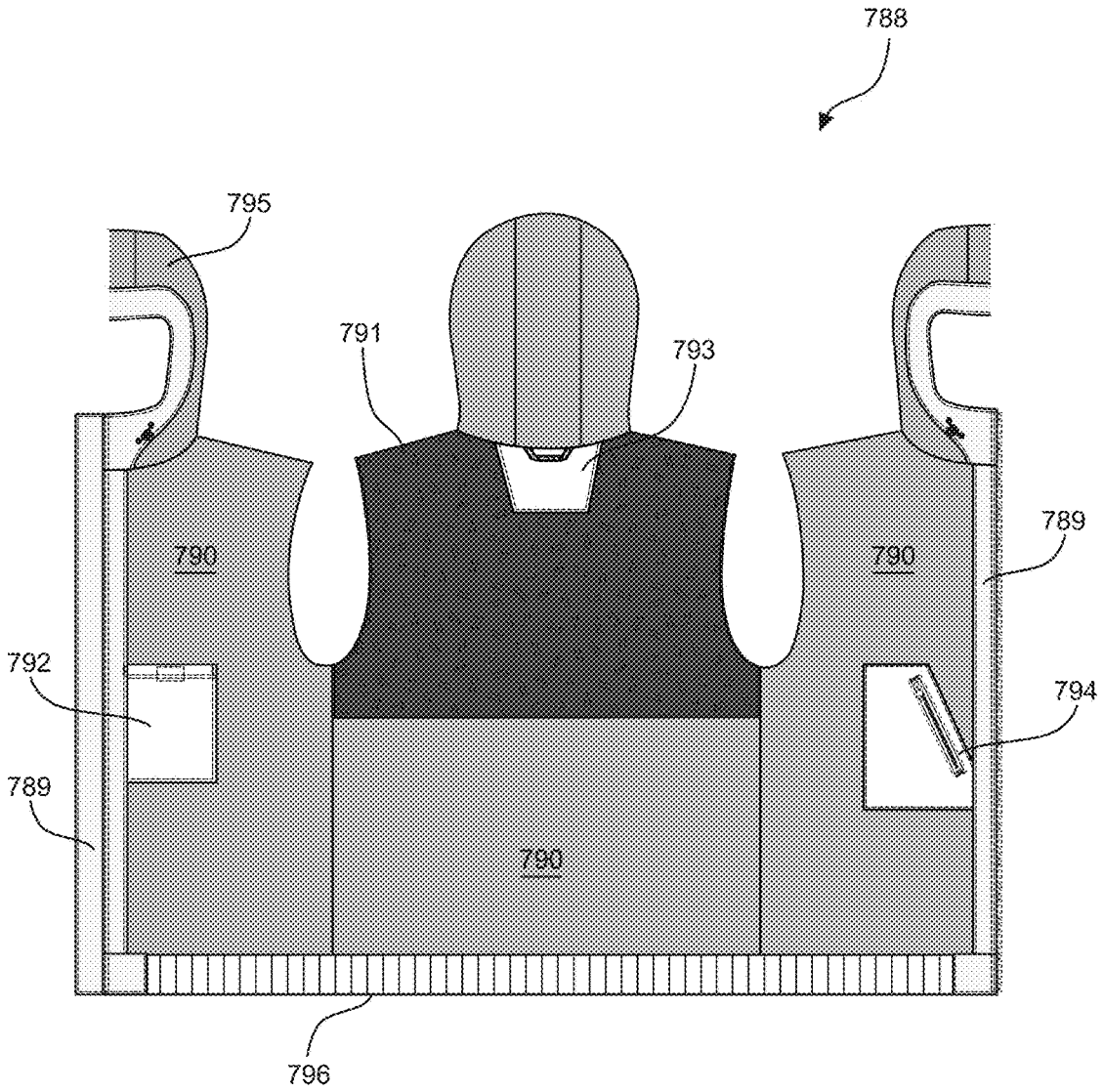
FIG. 7 illustrates the configuration of an assembled garment interior lining according to an embodiment of the present disclosure.

FIG. 7 shows a garment interior lining 788 that is attached to an inside portion of the outer shell layer 102, 202. Outerwear garment 100 may be made with additional linings or no linings, and such linings may be of suitable materials for lining types, e.g., quilted, plain, Sherpa, or Taffeta to name a few. Garment interior lining 788 may comprise a single fabric that is different from any fabric used in the outer shell layer 102. In some embodiments of the present disclosure, garment interior lining 788 may be integrated with the action back lining 464 and they may, together, also a form a single garment interior lining 788. Alternatively, the garment interior lining 788 may entirely overlay the action back lining 464, thereby sandwiching the action back lining 464 between the outer shell layer 102 and the garment interior lining 788.

As illustrated in FIG. 7, the garment interior lining 788 may comprises several components joined together. For example, garment interior lining 788 may comprise garment interior lining first fabric 789, garment interior lining second fabric 790 and garment interior lining third fabric 791 (which in some embodiments is the action back lining 464) may be joined together by various known means. In one such an embodiment, garment interior lining first fabric 789 may take the form of a sandstone shell fabric, garment interior lining second fabric 790 may take the form of a polyfleece fabric, and the garment interior lining third fabric 791 may take the form of a stretch Sherpa fabric. The garment interior lining 788 may also include various pockets 792, 794 (e.g., similar to pockets 124), and a garment hang tag area 793. Garment hang tag area 793 can serve one or more purposes, such as a location for a hangtag, labeling and/or a lanyard access (not shown). Hood lining 795 and waist band 796 may be joined to, or be integral with, any other lining fabrics of garment interior lining 788.

As should be apparent to one of ordinary skill, many styles could be created using embodiments of the present disclosure. As also should be evident to a person of skill in the art, embodiments of the present disclosure dramatically shift the focus of work apparel from merely protection to a highly versatile outerwear garment that serves for protection, comfort and an improved ease of motion (therefore, wearer vitality in whatever active environment the wearer is in).

The present disclosure has been described in accordance with the embodiments shown, and there could be variations to the embodiments, and any variations would be within the spirit and scope of the present disclosure. For example, exemplary embodiments can be implemented using various materials, sewing and stitching, and appendages and still replicate the present embodiments. It will be understood that this structure could be applied to other upper garments, e.g., coats, shirts, jackets, uniforms, and so on.

While the invention has been described with reference to certain embodiments, it will be understood by those skilled in the art as well that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

We claim:

1. An outerwear garment with a concealed stretch back layer comprising:
   - an outer shell layer comprising a front portion corresponding to a wearer's front and a back portion corresponding to a wearer's back;
   - an exterior layer action back constructed in the upper shell layer region of the outer shell layer and integrated into the back portion of the outer shell layer;
   - an arm sleeve panel attached to the outer shell layer at least at the front portion and the back portion of the outer shell layer; and
   - an action back lining comprising the concealed stretch back layer discrete from the outer shell layer and positioned in the back portion of an upper shell layer region of the outerwear garment; the concealed stretch back layer comprising a stretch panel and a shell panel joined together and to the outer shell layer.

2. The outerwear garment of claim 1, wherein the exterior layer action back is a bi-swing action back.

3. The outerwear garment of claim 1, wherein the concealed stretch back layer is joined to the outer shell layer at least at a midriff back seam, a shoulder seam and an outer shell layer side seam.

4. The outerwear garment of claim 1, wherein the concealed stretch back layer is a material with a degree of elastic or elastic-like properties.

5. The outerwear garment of claim 1, wherein the concealed stretch back layer is a stretch knit fabric.

6. The outerwear garment of claim 4, wherein the concealed stretch back layer is a stretch knit fabric.

7. The outerwear garment of claim 1, wherein the action back lining further comprises a facing panel joined together with the shell panel and set into a stretch panel seam.

8. The outerwear garment of claim 1, wherein the action back lining further comprises a shell fabric facing piece.

9. The outerwear garment of claim 1, wherein the action back lining further comprises an outer fabric layer positioned on top of a stretch panel, a shell panel and a facing panel that are joined at one or more facing edges.

10. The outerwear garment of claim 3, wherein the action back lining is joined to the outer shell layer at one or more of the shoulder seam, outer shell layer side seam, and midriff back seam.

11. The outerwear garment of claim 3, wherein the action back lining is joined at least at the midriff back seam of the outerwear garment.

12. The outerwear garment of claim 1, wherein the arm sleeve panel is joined to the outer shell layer at a shoulder seam by a triple stitch seam.

13. The outerwear garment of claim 1, wherein the arm sleeve panel further comprises a front arm sleeve pleat.

14. The outerwear garment of claim 1, wherein the arm sleeve panel further comprises a front arm sleeve pleat and a back arm sleeve pleat.

15. The outerwear garment of claim 1, wherein the arm sleeve panel is joined to the outer shell layer through an armhole gusset located in an armpit area of the outerwear garment.

16. The outerwear garment of claim 15, wherein the armhole gusset is configured to fold back on itself along a fold line, when a wearer's arm is in a relaxed position.

17. The outerwear garment of claim 15, wherein the armhole gusset is configured to fold back on itself in an accordion-like fashion, forming an accordion-like fold at an inner angle of a wearer's armpit, when a wearer's arm is in a relaxed position.

18. The outerwear garment of claim 1, wherein the outer shell layer and the arm sleeve panel comprise a single fabric.

19. The outerwear garment of claim 1, wherein outer shell layer and the arm sleeve panel comprise one or more materials comprising cotton, duck, nylon, Sherpa, synthetic, fleece, rip stop cotton, insulating material, abrasion resistant material, tear resistant material, rip resistant material, puncture resistant material, heat resistant material, electrically insulating material, fire resistant material, flame proof materials, elastic materials, material blends or sandstone.

20. The outerwear garment of claim 1, further comprising a garment interior lining attached to an inside portion of the outer shell layer.

21. The outerwear garment of claim 1, further comprising a garment interior lining attached to an inside portion of the outer shell layer and overlaying the action back lining.

22. The outerwear garment of claim 1 further comprising an armhole gusset and an arm interior lining stretch piecing comprising an armhole gusset stretch fabric positioned and shaped to work in a complementary fashion with the armhole gusset.

23. The outerwear garment of claim 22 further comprising an arm sleeve pleat and an arm interior lining stretch piecing comprising an elbow stretch fabric positioned and shaped to work in a complementary fashion with the arm sleeve pleat.

24. The outerwear garment of claim 1 further comprising an arm sleeve pleat and an arm interior lining stretch piecing comprising an elbow stretch fabric positioned and shaped to work in a complementary fashion with the arm sleeve pleat.

25. The outerwear garment of claim 1, further comprising a garment interior lining that comprises a single fabric different from any fabric used in the outer shell layer.

26. The outerwear garment of claim 1, further comprising further comprising a garment interior lining that is integrated with the action back lining to form a single interior lining.

27. The outerwear garment of claim 1, further comprising a garment interior lining comprises a garment interior lining first fabric, a garment interior lining second fabric and a garment interior lining third fabric.

28. The outerwear garment of claim 27, wherein the garment interior lining first fabric is a sandstone shell fabric, the garment interior lining second fabric is a polyfleece fabric, and the garment interior lining third fabric is a stretch Sherpa fabric.

* * * * *